US007612978B2

(12) United States Patent
Bergstrom et al.

(10) Patent No.: US 7,612,978 B2
(45) Date of Patent: Nov. 3, 2009

(54) THREE WIRE DRIVE/SENSE FOR DUAL SOLENOID

(76) Inventors: Gary E. Bergstrom, 191 Miles Rd., Moreland Hills, OH (US) 44022; Joseph B. Seale, 98 Day Rd., Gorham, ME (US) 04038

( * ) Notice: Subject to any disclaimer, the term of this patent is extended or adjusted under 35 U.S.C. 154(b) by 78 days.

(21) Appl. No.: 11/584,373

(22) Filed: Oct. 20, 2006

(65) Prior Publication Data

US 2007/0242408 A1 Oct. 18, 2007

Related U.S. Application Data

(60) Provisional application No. 60/728,529, filed on Oct. 20, 2005.

(51) Int. Cl.
*H01H 47/00* (2006.01)

(52) U.S. Cl. ..... 361/160; 361/166

(58) Field of Classification Search ..... 361/139, 361/143, 160, 166; 335/159
See application file for complete search history.

(56) References Cited

U.S. PATENT DOCUMENTS 4,544,986 A * 10/1985 Buchl ..... 361/152
6,724,606 B2 * 4/2004 Seale et al. ..... 361/160

* cited by examiner

*Primary Examiner*—Danny Nguyen

(57) ABSTRACT

A dual-acting solenoid, consisting of one armature moving between two latching positions against two yokes with two drive windings, is interconnected to bring out three wire terminations: a center and two ends. The electronic drive circuitry is similarly configured for three terminals. Optionally, the drive circuitry includes sensing and computation sufficient to determine the two currents and the two inductive voltages associated with the two windings. A method is shown for using six measured or computed parameters, two inductive voltages, two currents, and two time derivatives of current, to determine the simultaneous position and velocity of the armature. The method involves simultaneous solution of the equations for current and voltage in two time-varying inductors where the two inductances are constrained to correspond to the position of a single armature moving between two fixed magnetic yokes.

9 Claims, 6 Drawing Sheets

THREE WIRE DRIVE/SENSE FOR DUAL SOLENOID

CROSS-REFERENCE TO RELATED APPLICATIONS

Provisional Patent Application 60/728,529 filed 2005 Oct. 20

STATEMENT REGARDING FEDERALLY SPONSORED RESEARCH OR DEVELOPMENT

Not applicable

FIELD OF THE INVENTION

This invention relates to electronic methods for driving dual-acting solenoid actuators, employing two electromagnetic yokes to move a single armature between two latching positions. The invention is particularly applicable to electromagnetic actuation in engine valve solenoids, using a minimum of wiring and electronic hardware.

BACKGROUND OF THE INVENTION

The concept of dual-acting solenoid actuators, particularly for engine valve actuation, goes back to the early 1900s. The historic approach is illustrated schematically in FIG. 1 (Prior Art), wherein an armature 120 drives a shaft 130 (labeled at both top and bottom ends), which may typically be coupled to a cylinder valve (not shown) for operation of a camless internal combustion engine. The armature and shaft are restored by one or more springs (not shown) toward a position intermediate between upper magnetic yoke 100 and lower magnetic yoke 105. Yoke 100 is driven electrically by coil 110, whose wire leads (not shown) are energized by an electronic driver circuit (not shown). Yoke 105 is similarly driven similarly by coil 115, whose wire leads (not shown) are energized by a second electronic driver circuit (not shown). When a driver circuit causes an electric current to flow through coil 110, then a magnetic field is induced in yoke 100, with part of this field bridging across an air gap to armature 120, which is thereby attracted upward toward 100. Similarly, when a second driver circuit causes a current to flow in coil 115, a magnetic field is induced in yoke 105, attracting armature 120 downward toward 105. Using appropriate electrical output signals from the two electronic drivers, it is possible to move armature 120 into either of two latching positions, on the upper side against yoke 100 or on the lower side against yoke 105.

Variations on the above approach to hardware design and actuation control are possible. The armature and two yokes might, for example, be configured as a circular or truncated-circular armature attracted to yokes having the general form of pot cores. Alternatively, the armature might be rectangular and might be drawn alternately to opposite E-core yokes. In yet another configuration, a horizontal armature might rock up and down about a rotary shaft at a lateral end of the armature between an over-and-under pair of electromagnetic yokes. These configurations share in common that there are two electromagnetic yokes and two windings, independently driven by two electronic driver circuits.

Since the present invention concerns improvements in the electronics to drive an otherwise "conventional" dual-acting and dual-winding solenoid, it is worth discussing some of the constraints on achieving effective and efficient solenoid actuation. Each of the two windings (110 and 115) of FIG. 1 (or in a variation on the topology of FIG. 1) needs to be driven strongly in both "forward" and "reverse" voltage polarities: "forward" to build up the magnetic field quickly and overcome resistance losses at high peak currents for armature pull-in; and "reverse" to reduce the forward current and attenuate the magnetic field quickly for armature release. If an active reverse voltage is not available (for example, if only passive resistance and one or more forward diode voltage drops is available to slow the forward flow of electric current), then the armature release will be slowed substantially by an un-attenuated magnetic field as the armature pulls away from the releasing yoke. The attracting field at pull-away will oppose the force of the spring that accelerates the armature toward the opposite yoke, thus removing mechanical energy that is likely to be needed for getting the armature within pull-in range of the opposite yoke. Furthermore, in order to build up and attenuate the magnetic field rapidly with a given limited power supply voltage, the number of turns in each winding (such as 110 or 115) is strictly limited—the slew rate for changing magnetic flux linkage varies inversely as the number of turns for a given drive voltage. When the winding count is thus set low enough to achieve the needed magnetic slew rate, then the total resistance in each winding is a small fraction of an ohm, while the electric current needed for magnetic pull-in toward latching is typically measured in tens of amperes (for example, in a 12-volt or 42-volt automotive system.) To minimize electrical losses at the necessary high currents and low impedances, therefore, the electronic drive circuitry is generally a Pulse Width Modulation (PWM) circuit employing output devices with very low on-resistances (as with Field Effect Transistors or FETs) or very low forward voltage drops (as with bipolar transistors or related devices). The solution to this electronic drive design problem, with single-supply operation, is commonly to employ a full-wave bridge circuit with an active pull-up and pull-down device for each of the two winding leads on each of two coils: a total of four leads and eight high-current driver devices. For purposes of discussion, a driver circuit capable of applying active forward and reverse voltages to a single winding will be referred to as a "single driver," which might consist of a full-wave bridge using a single supply or a totem pole topology with dual positive and negative power supplies sharing a common ground or current return path. In this context, a conventional dual-acting solenoid system requires a "dual driver" consisting of a pair of single drivers.

Two "single-driver" approaches for dual-acting solenoids have previously been described for reducing the wiring and electronic hardware needed to operate a dual acting solenoid actuator. First, in the system of European Patent EP0992658 and U.S. Pat. No. 6,651,954 B1, Porcher et. al. describe a simplified system achieving solenoid action of a single armature with latching in either of two positions. As shown in FIG. 2 (Prior Art, adapted from U.S. Pat. No. 6,651,954), a single winding 38 creates a magnetic potential difference between yoke element 36 on the left and mirror-image yoke element 37 on the right. Each of two curving jaws 36 and 37 of the yoke carries a magnetic polarity, one jaw at north polarity and the other at south. Each of the jaws meets one end of a moving armature 22 in either of two axial latching positions. When the armature is far off-center near one of these latching positions, magnetic forces predominate across the smaller yoke-armature gap on the side close to latching, giving rise to a strong force toward completed closure and latching on that side. Thus, application of current to the single winding can be used to latch the armature in either of two positions. Some drawbacks to this invention are noted here. The geometric constraints of bringing magnetic flux down from a winding on the top end of the solenoid to a bottom latching area result in a substantial increase in the vertically-projected footprint area of the solenoid, as compared to conventional solenoids with separate windings on separate yokes. Space is required for the flux-carrying cross-section to bring flux down to the bottom latching poleface area. Further space is required to provide an adequate lateral gap between the sides of the armature and the adjacent inside vertical surfaces of the yoke. Narrowing the lateral gaps between armature and yoke causes high leakage of flux across the armature for all axial positions in the armature travel, resulting in flux that creates no axial attraction for moving the solenoid armature along its intended travel axis. This non-functional leakage flux uses flux-carrying capacity in both the armature and the yoke, lowering the achievable magnetic forces as limited by saturation of the yoke. The non-functional flux also results in a high stray winding inductance, which must be overcome by higher drive voltages.

The second previous approach for reduced wiring and switching hardware, described by the present inventors (Bergstrom and Seale) in U.S. Pat. No. 6,724,606, is to maintain a relatively conventional dual solenoid magnetic topology but simply to wire the two yokes in series. As illustrated in FIG. 3 (Prior Art), winding area 310 is associated with upper E-core yoke 300 while winding area 315 is associated with lower E-core yoke 305, but the two winding areas 310 and 315 are interconnected via wire 365, forming a single electrical circuit between terminals 360 and 370. Other features are similar to the prior art configuration of FIG. 1, for example vertical shaft 330 of FIG. 3 corresponding to shaft 130 of FIG. 1 and armature 320 corresponding to 120.

Functionally speaking, series interconnection is not a bad tradeoff when the armature is not too close to its center position. For an off-center armature, most of the impedance and over half the electrical losses are associated with the "working" side of the series-connected yokes—the side closer to the armature. On this "working" side there is a higher inductance, higher flux levels, and consequently higher magnetic hysteresis losses. The yoke farther from the armature adds its share of resistive loss at all times, but as explained in U.S. Pat. No. 6,724,606, winding resistances in typical valve actuation solenoids are not the most important sources of energy loss. When wound with few enough turns to permit a needed flux slew rate (as discussed above), winding resistance is typically only a small fraction of an ohm. Thus, non-winding circuit resistances in electronic switching devices, circuit board traces, and connectors tend to predominate over winding resistances, unless there is a significant monetary investment in large electronic components and large or thick board traces. In a single-winding configuration, one set of driver electronics is used instead of two. Part of the electronic cost saving can therefore go into larger switching devices, larger or thicker foils, etc., offsetting part of the resistance increase of the series windings while the overall system cost is still reduced.

Both the parallel magnetic topology of FIG. 2 and the series winding topology of FIG. 3 present startup problems—magnetic purchase to get started is very low unless there is a considerable magnetic asymmetry at the spring-neutral rest position. FIGS. 2 and 3 both indicate ways of creating magnetic asymmetry for a centered armature. In FIG. 2, magnetic element 84 creates this asymmetry, being attracted upward when the armature is centered and a winding current is applied. In FIG. 3, the armature is made asymmetric by beveling surface 325 near the outer edge of armature 320 and providing a sloped matching surface on yoke 305. There may be reasons, however, for biasing the armature-restoring springs to give the entire armature an off-center spring-neutral position. Note, for example, that armature 320 is shown in a spring-neutral position that is off-center below the midpoint between upper and lower latching positions. A certain asymmetry might be called for in optimizing a valve actuator for an asymmetric mechanical load. For example, an exhaust valve actuator can benefit from a spring that is biased to favor opening of the valve more than closing, since valve-opening must be performed against the opposing pressure of exhaust gases.

Even with asymmetries of armature construction and centering, single-driver dual-latching solenoids are likely to have very little starting force. Even in conventional topologies (as in FIG. 1) with separate drivers on each winding, the force of attraction between the centered armature and either yoke tends to be low. The achievable magnetic pull increases steeply in the final small fraction of travel from centered to latching position. Thus, it is commonly required to alternately energize the upper and lower winding circuits at a mechanical resonance of the armature and its restoring spring system, building up oscillatory amplitude until the armature comes close enough to be pulled in and latched by a yoke. Once latching is achieved on either side, the single-driver approach is comparatively more effective. The starting problem described here is addressed by the invention disclosed below.

Another area of concern for the present invention is sensorless determination of armature position and velocity, particularly for use in dynamic servo control of armature motion. An important application for effective servo control is the soft landing of engine valves, to reduce noise and extend valve and actuator life. An apparatus and method for sensorless determination of armature position, including for servo control, has been described by an author of the present patent (Bergstrom) in U.S. Pat. No. 6,249,418. In the case of a dual-acting solenoid, Bergstrom's invention would use information from a single solenoid winding (for example, recent history of measured current and the known sequence of applied voltages) to determine the effective magnetic gap between the armature and the magnetic yoke on one side. The technique might be applied to both yokes of a dual-acting solenoid, so that position would be determined redundantly or based on the one of two yokes that yields better information about position at a given moment. When the four solenoid wires are interconnected to bring out fewer wires, for example three, then the problem of sensorless determination of position or velocity is altered and problems arise. As will be seen, the present invention addresses this sensorless control issue.

OBJECTS OF THE INVENTION

It is an object of the present invention to interconnect the windings of a dual-acting solenoid having two drive windings coupled to two electromagnetic yokes that act bi-directionally on a single armature, so that three rather than four connections are made to electronic driver circuitry: two end connections from separate yoke windings and a center connection common to the separate yoke windings, those three connections (or wires, or terminals) being driven by an electronic driver apparatus offering switching regulation of the electrical signals applied to the three connections. It is a related object that the driver apparatus be capable of quickly energizing either one of the two solenoids with a large fraction (possibly up to 100%) of an available supply voltage and at currents up to a full rated current level, while little or no current flows in the remaining solenoid. It is a further related object that the driver apparatus be capable of applying, to one solenoid winding, a "braking" voltage up to a large fraction (possibly up to 100%) of the available supply voltage, in order quickly to reduce the current flowing in that winding subject to the "braking" voltage.

It is an object of the invention, in a dual-acting solenoid with one armature, two magnetic yokes, two drive windings associated with the two yokes, those drive windings being interconnected to provide two end connections and a common center connection, to achieve sensorless position measurement by measuring a current at a solenoid connection and determining a voltage at a solenoid connection (the voltage determination including voltage measurement or voltage control), and then inferring an armature position for that solenoid from the measuring of current and the determination of voltage. It is a related object to utilize prior knowledge of electromagnetic characteristics of the driven solenoid in the sensorless position measurement. It is a further related object optionally to determine the voltage differentials across both drive windings, to measure the currents flowing in both drive windings, to determine the rates-of-change of the currents flowing in both drive windings, and further utilizing prior knowledge of electromagnetic characteristics of the driven solenoid, to determine the position and the velocity of the armature.

These and other objects will become apparent in the following Specification.

LIST OF FIGURES

Figure 1:
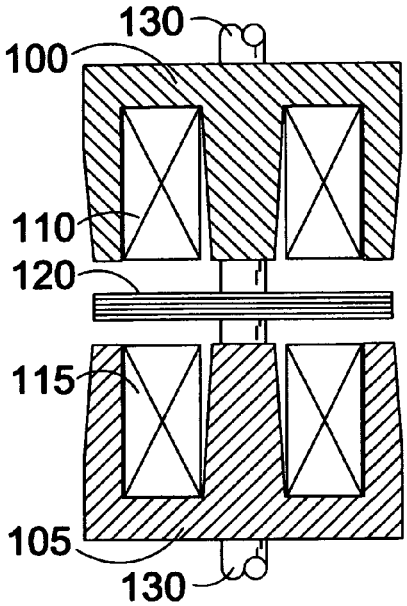
FIG. 1 (Prior Art)
FIG. 1 is an elevation section view of a single-armature dual-acting solenoid of the prior art, including two independent windings driving two separate magnetic yokes.
Figure 3:
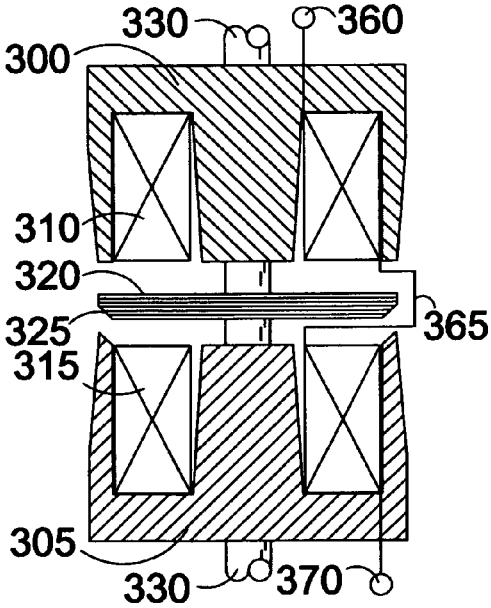
FIG. 3 (Prior Art)

FIG. 3, from the prior art, is similar to FIG. 1 except that the two windings of FIG. 1 have been series-connected to make an assembly driven via just two wires from a single electronic driver circuit.

Figure 4:
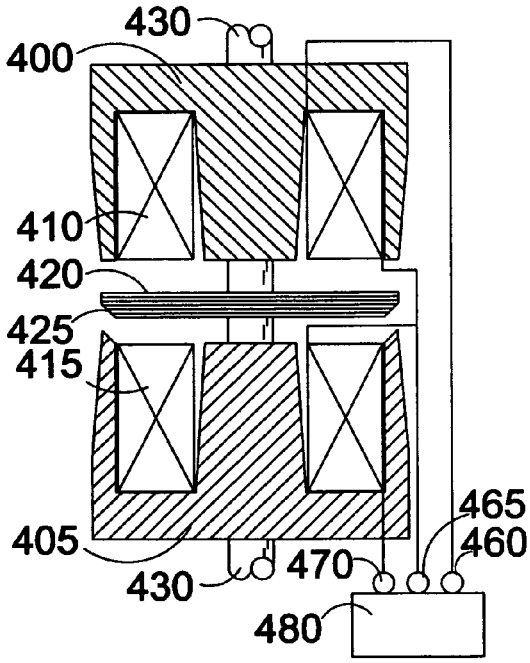

FIG. 4 is similar to FIG. 3 except that a connection from the wire series-connecting the two windings has been brought out to a three-wire controller.

Figure 5:
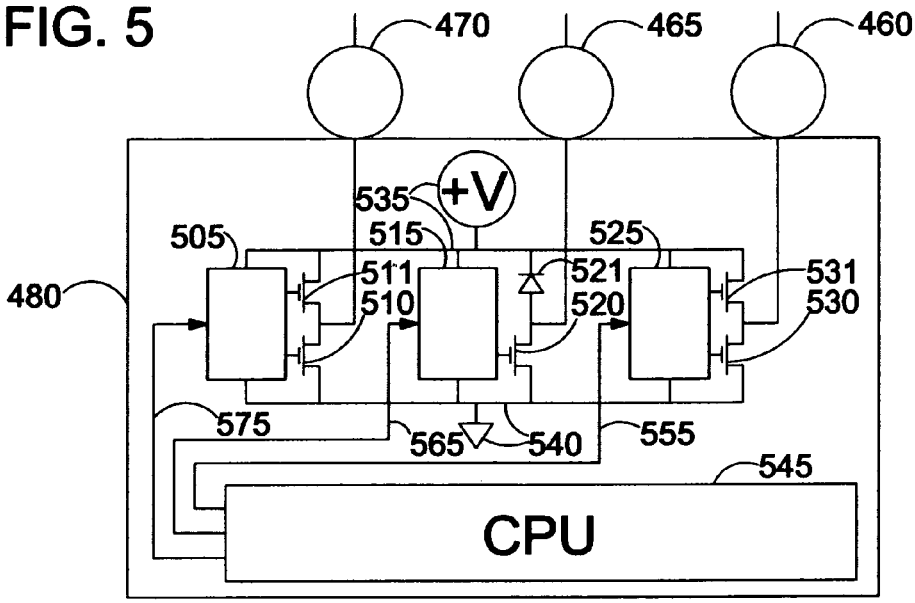

FIG. 5 is an electronic schematic indicating the nature of the three-wire controller of FIG. 4.

Figure 6:
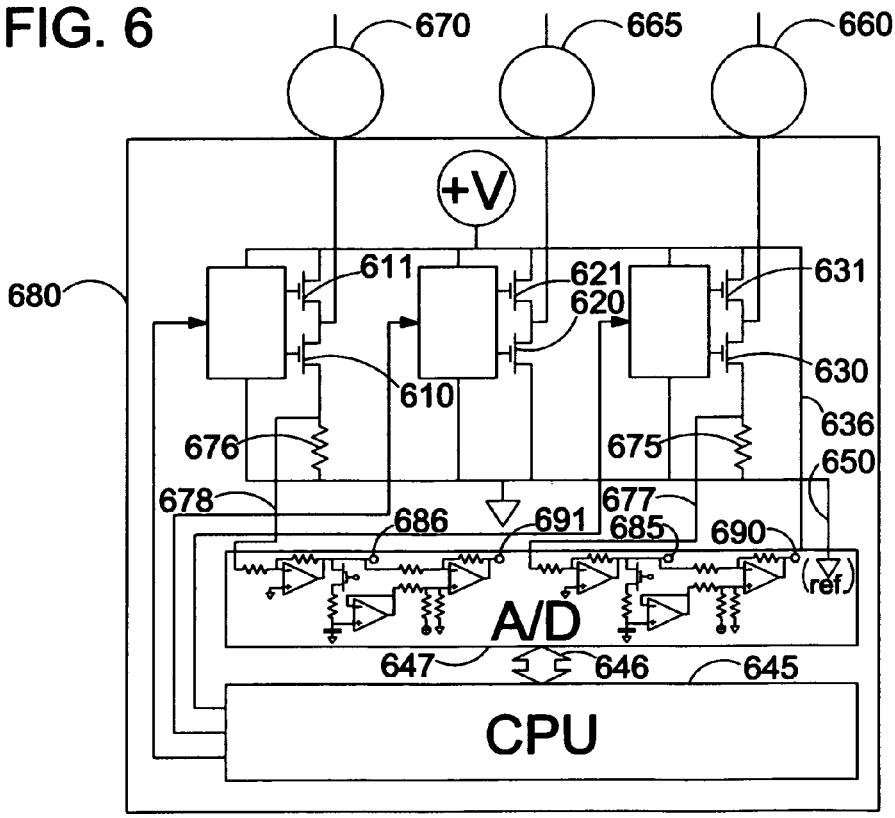

FIG. 6 is a modification of the schematic of FIG. 5, indicating measurement circuitry for determining armature position and velocity from current and voltage relationships via the three solenoid connections, without the need of separate sensors.

Figure 7:
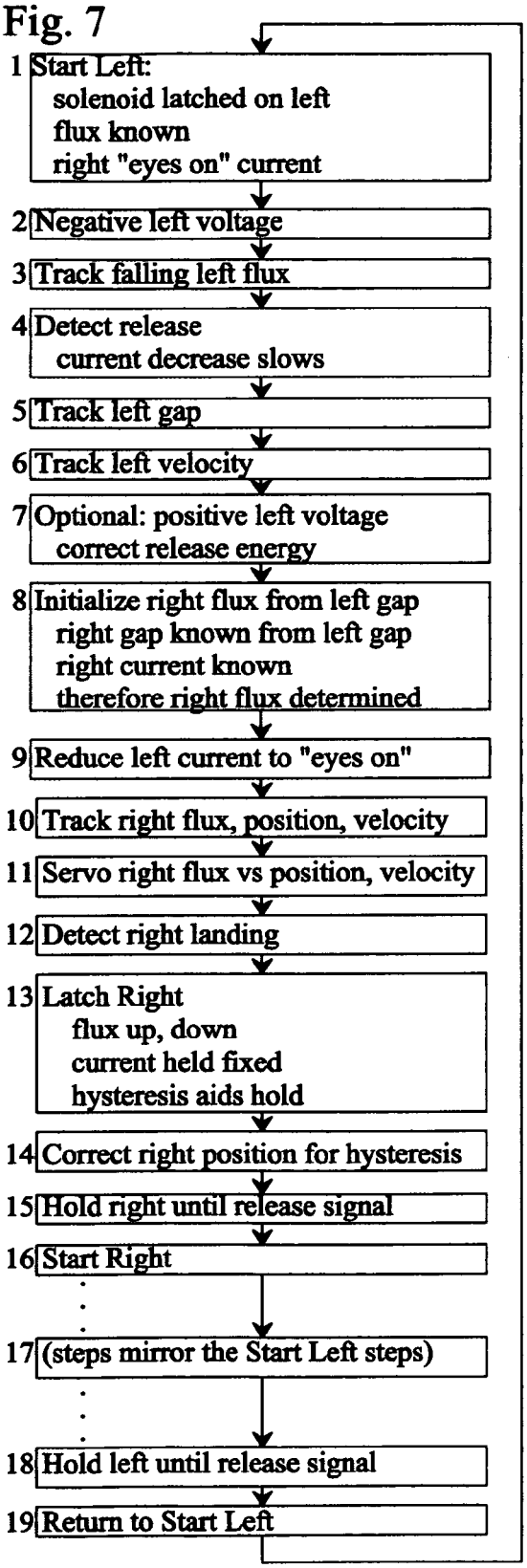

FIG. 7 is a computational flow diagram showing an example of electrical measurements and computations during sensorless servo-controlled armature trajectories back and forth between two yokes.

Figure 7A:
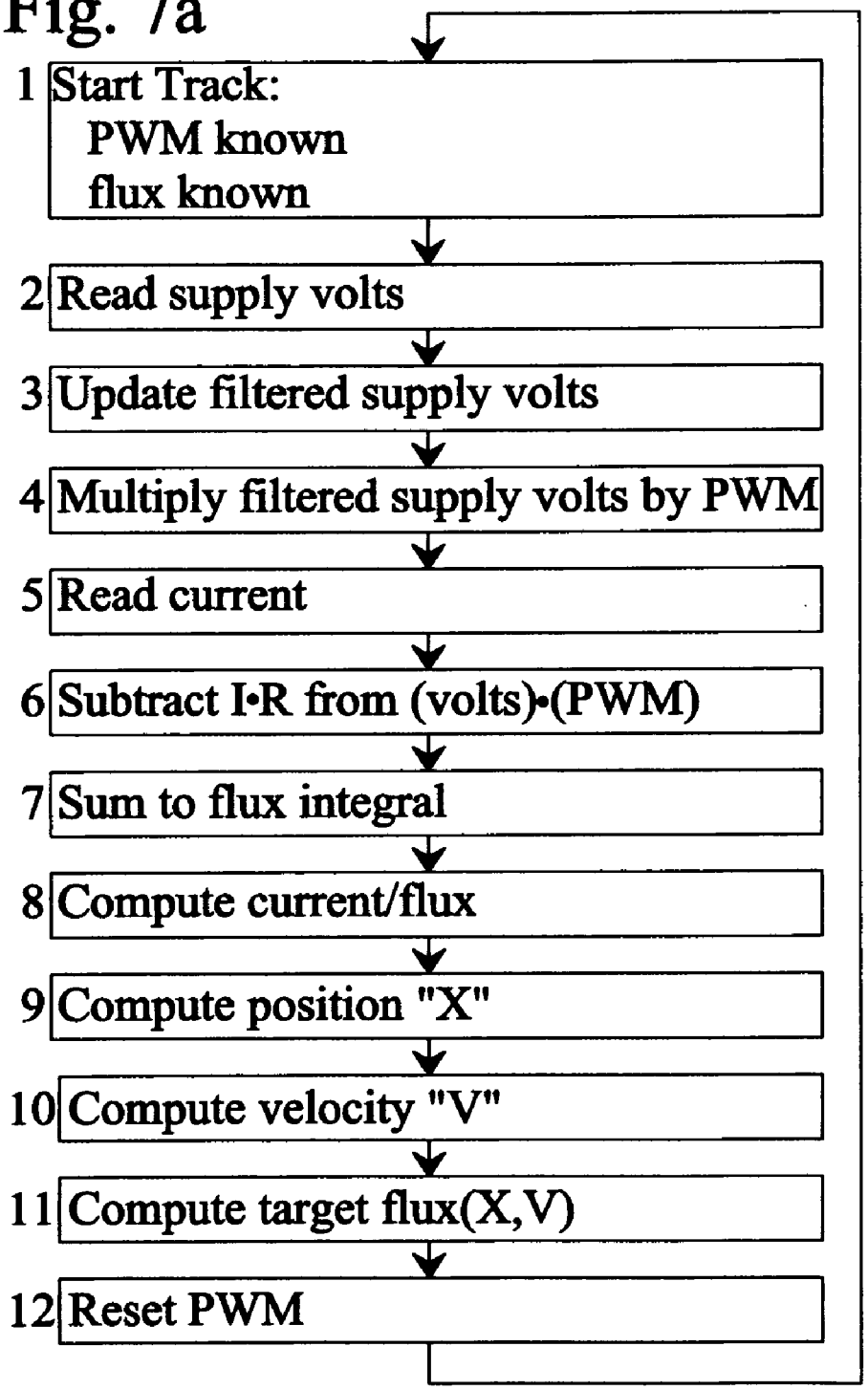

FIG. 7*a* shows steps repeated frequently within each loop through the steps of FIG. 7, involving flux integration and determination of position and velocity, applicable in a dual-acting three-wire solenoid or in a dual-acting four-wire solenoid.

Figure 8:
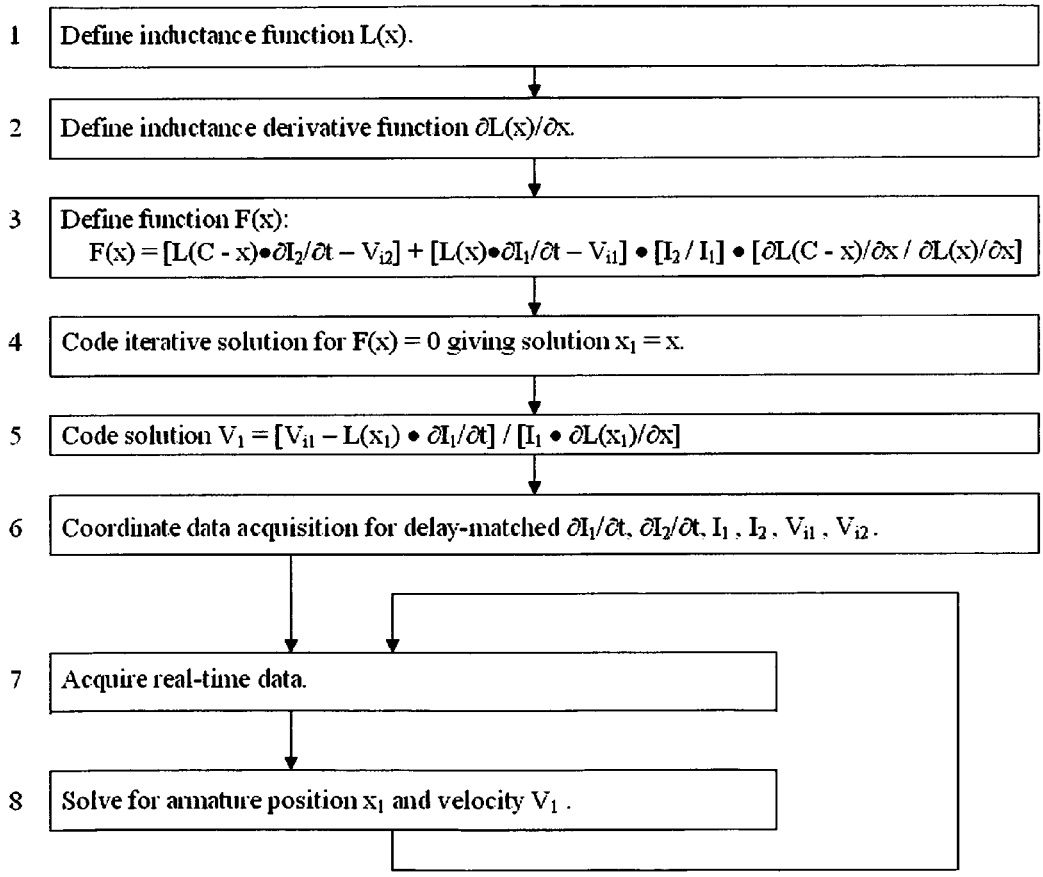

FIG. 8 is a computational flow diagram showing an example of electrical measurements and computations leading to a "differential" determination of position and velocity of the armature, applicable in a dual-acting three-wire solenoid or in a dual-acting four-wire solenoid.

Figure 9:
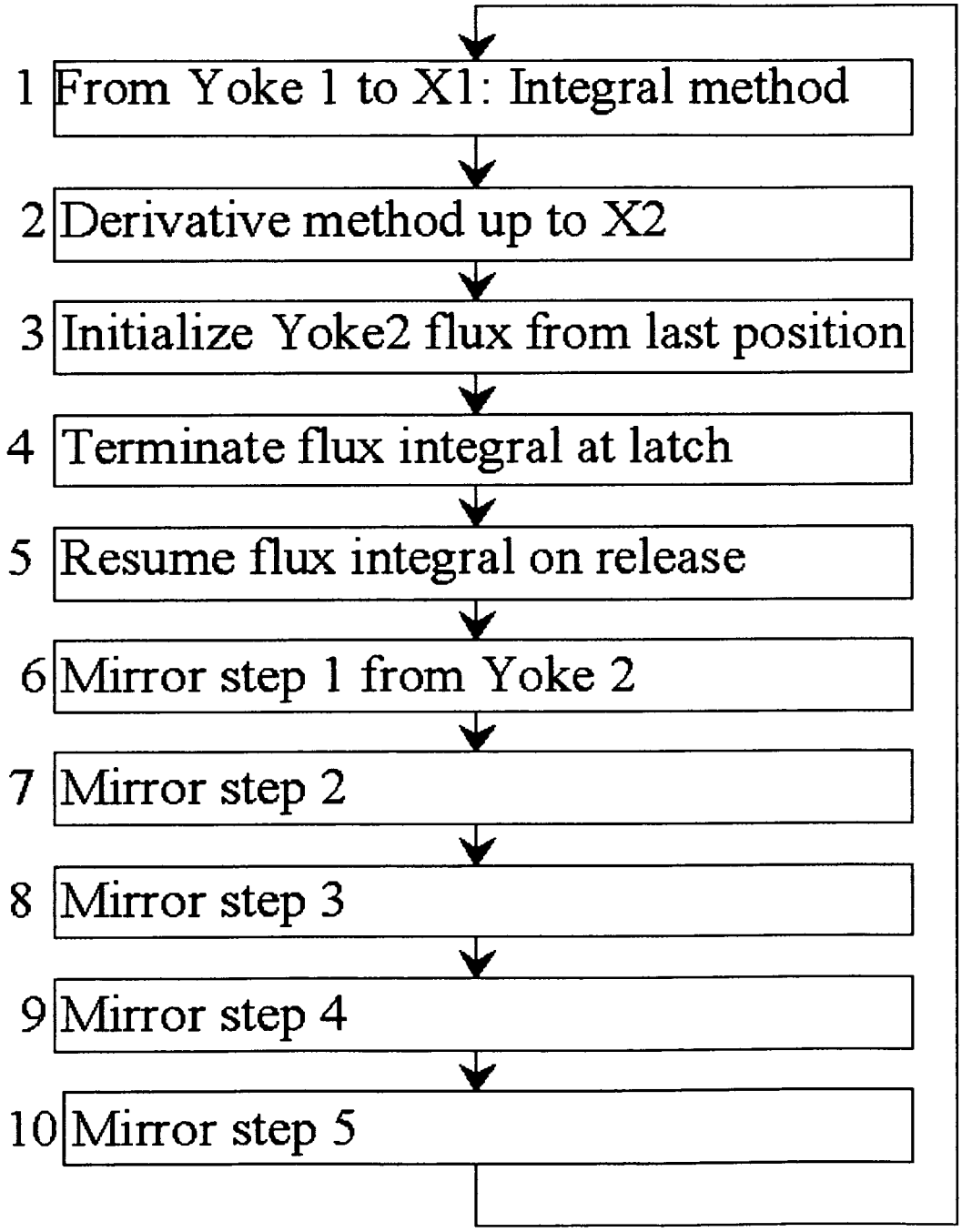

FIG. 9 is a computational flow diagram showing a hybrid control method, employing flux integration or flux derivative determination of position depending on which determination works best in a given portion of an armature trajectory.

SUMMARY OF THE INVENTION

Summary Part 1: Overview

The present invention is an improvement on pre-existing methods and electronic topologies for driving a dual-acting solenoid having one armature, two magnetic yokes, and two windings, for example as illustrated in FIG. 1. This invention achieves actuation and control with less wiring and less driver circuitry than is associated with four-terminal drive electronics, as conventionally employed in the dual-acting topology of FIG. 1. The invention overcomes difficulties and limitations associated with the two-terminal approaches illustrated in FIGS. 2 and 3 for reducing wiring and driver circuitry. The novel three-terminal interconnection of the invention is illustrated in FIG. 4.

In addition to a simplified and highly effective three-terminal driver topology, the present invention provides for current and voltage sensing plus computation methods that lead to sensorless determination of armature position and velocity. Thus, position and velocity are computed based on system knowledge and measurements of voltages and currents at the controller end of the solenoid wiring without use of separate sensors in the solenoid nor need of sensor wiring to the solenoid. Two approaches will be shown for sensorless position/velocity determination. One of them derives from flux-integration methods taught by Bergstrom in U.S. Pat. No. 6,249,418. The other "differential" approach is a novel method based on determinations of voltage, current, and rate-of-change of current, without reliance on drift-prone flux integration. A hybrid of the two methods offers superior reduction of both noise and drift.

Summary Part 2: Hardware of the Three Wire Topology

The wiring topology of this invention connects one electrical conductor from each of two yoke windings to create a center terminal, used in conjunction with the remaining two conductors to make a three-terminal solenoid, driven electronically by a three-terminal driver. As will be shown, compared to the conventional dual-winding and dual-driver system of FIG. 1, the three-terminal solenoid system illustrated in FIG. 4, driven by the three-terminal driver system of FIG. 5 achieves almost as much electronic simplification as that of FIG. 3 while overcoming the major limitations of difficult starting and difficult sensorless control.

The system of FIG. 6 adds current and voltage sensing to that of FIG. 5, enabling "sensorless" servo control, relying on inference of armature position and velocity from information obtained at the controller end of the solenoid wiring without the use of sensors in the solenoid itself.

Examining the hardware of the invention in more detail, the system of FIG. 4 brings out three conductor leads (460, 465, and 470) from two solenoid windings to a three-terminal controller 480. This three-wire topology is fundamental to the present invention.

FIG. 5 shows an example of the driver electronics of the controller 480, consisting of two totem pole end driver circuits (creating a full bridge) and a single on-off grounding device with a clamp diode to the positive supply at the center terminal. In this configuration, when the center device switches "on" to pull the center terminal voltage to ground potential, then either end totem pole may independently pull up an end voltage, energizing a selected one of the two solenoid windings. As will be discussed in more detail, this configuration does almost everything that is conventionally accomplished in a four-wire system, avoiding the start-up problems and increased losses of a two-wire system.

FIG. 6 shows current sense circuitry added to the drive circuitry of FIG. 5, also with one alteration in the driver circuitry: the center terminal in FIG. 6 is driven by a totem pole driver, with an active pull-up transistor replacing the clamp diode of FIG. 5. Either the FIG. 5 or FIG. 6 variation on driver circuitry is considered as a highly favorable configuration for this invention, with the active pull-up of FIG. 6, and the associated drive circuitry (not shown), adding cost but conferring benefit in performance and in accurate sensorless determination of inductive voltage, as will be discussed.

Summary Part 3: Sensorless Position and Velocity Determinations

FIGS. 7, 7*a*, and 8 and accompanying text define "integral" and "differential," methods for sensorless determination of position and velocity, to be summarized below.

FIGS. 7 and 7*a* show steps for sensorless determination of position by flux integration. The concepts behind those steps are explained here.

In a solenoid, the "effective magnetic gap" is given by the ratio of "ampere-turns" to "flux-linkage," or ampere-turns/flux-linkage. For a given solenoid geometry and for un-saturated solenoid operation, the geometric position of the armature can be calibrated as a function of the effective magnetic gap. Electromagnetically induced voltage equals the time-derivative of flux-linkage. Thus, the change in flux linkage can be computed, over time, by integration of induced voltage, also known as inductive voltage.

To measure induced voltage, one measures the total voltage applied to a solenoid winding and then subtracts the voltage attributed to ohmic resistance. In the dual-winding three-wire solenoid topology of the present invention, the applied voltages (before resistive correction) at the two end terminals are computed based on supply voltage and PWM duty cycle: a weighted average of ground potential (zero) and the measured supply potential. The currents at the two end terminals are measured. The current at the center terminal is the sum of the two end-terminal currents (with appropriate sign.) The computed applied voltage at each end terminal is corrected for resistive voltage drop, taking account of duty cycle and determining a weighted average of the on-state resistances of the upper and lower totem pole devices. Computation of the center-terminal voltage depends on the topology and the drive signal (high or low) during the time interval of interest. For the FIG. 5 topology with a clamp diode, the low-state voltage is ground potential plus a current-times-on-resistance correction. The high-state voltage is the supply potential plus a (normally) forward diode potential based on current and a logarithmic voltage model plus a resistive term. For the FIG. 6 topology with a pull-up FET, the diode model is replaced by a generally more accurate estimate of resistive voltage across the pull-up FET. With the corrected center and two end voltages, voltage differentials are computed across the two windings. These differentials are corrected for ohmic voltages in the windings. The resulting two inductive voltages are integrated to give the change in flux linkage in each winding over time. The cumulative flux integrals are initialized or re-initialized to absolute values of flux linkage during moments when armature position is known independently, meaning that the ampere-turn/flux-linkage ratio is known and flux-linkage is computed from measured ampere-turns. Absolute armature position is known, for example, when the armature is latched.

There is some technique involved in using the partially redundant information from two windings and two flux integrals, first to determine a single armature position, and second to use redundancy to correct for drift in the flux linkage integrals. For a winding on the far side from the latched armature, the position is known and flux linkage is readily computed from current. As the armature begins to move, the changing flux integral is well defined, but position based on the large magnetic gap is poorly resolved because computed position is very sensitive to errors in the ratio of ampere-turns/flux-linkage and, secondly, the denominator flux-linkage tends to be small for a winding and yoke "looking out" across a large magnetic gap. The situation for the releasing side of the same solenoid is quite different. The flux linkage may be inexactly known because of effects during latching and release, including hysteresis and possible armature flexing with imperfect mating contact in a situation where magnetic reluctance is extremely sensitive to the closeness of mating contact. The computed position, fortunately, is relatively insensitive to errors in flux-linkage at small magnetic gaps. Thus, as the solenoid releases, initial estimates of position are derived largely or entirely from magnetic data on the releasing side. As the armature progresses across, the position estimate becomes a weighted average, shifting from the releasing yoke and winding to the pull-in yoke and winding. The best estimates of position come from the pull-in winding on approach to landing—where resolution of position and velocity are most critical. Velocity is based on changes in computed position.

FIG. 8 shows steps for sensorless determination of position by a differential method involving simultaneous solution for the two sides of a dual solenoid. The concepts behind those steps are explained here.

The sampled data described above are resolved into six time-varying parameters:

For the left-hand winding: 1) voltage, 2) current, and 3) time derivative of current.

For the right-hand winding: 4) voltage, 5) current, and 6) time derivative of current.

As in the integral determination described above, the end applied voltages are determined from the supply voltage and the PWM duty cycles of the two totem pole circuits. The center applied voltage depends on the high or low setting of that terminal and on the pull-up topology: passive diode pull-up as in FIG. 5, or active pull-up as in FIG. 6. Before current corrections, the center terminal voltage is taken as ground or the positive supply voltage, depending on the low or high state established by the drive signal. The end currents are measured and summed to give a center-terminal current. Voltage corrections for currents are computed as outlined above. These corrections include both drive circuit voltage changes and winding resistance losses.

The equations for determining position and velocity are given under "Description of a Preferred Embodiment." The following text outlines the physical principles behind those equations and the basic nature of the equations.

In each winding, the flux linkage equals the product "I·L", current times inductance. The time derivative of this product "I·L" is equal to the known inductive voltage, as computed based on measured or computed voltages, currents, and resistive voltage losses. Furthermore, the current "I" is known for each winding, as is the time derivative of current, "$\partial I/\partial t$". Finally, inductance L is a known function of armature position x, that is, $L=L(x)$, where this function is determined by measurement of the type of solenoid to be controlled and expressed in computable form, for example as a lookup table or an empirical equation that gives a good fit to the data. Given all the measured data and the known functional relationship "L(x)", one is left with just two unknown variables: armature position "x" and armature velocity "∂x/∂t". Furthermore, one has two governing equations, one for the left winding and one for the right winding. Each of these two equations has the form "$V_i$="∂(I·L)/∂t", where $V_i$ is the inductive voltage across the winding. Expanding the derivative of the product "I·L", using the calibration function "L(x)" and the derivative of this function, "dL/dx", and finally using the chain rule for differentiation, it is possible to express the two governing equations in terms of the two unknowns, "x" and "∂x/∂t". Further refinements might call for correction terms for eddy currents, but the basic structure of two simultaneous equations remains. These equations are nonlinear but can be solved iteratively. Furthermore, given an initial solution at a known latching position "x" with a known velocity of zero, each new iterative solution in a sampled data system will be close to the previous iterative solution. Furthermore, inertia in the system will prevent the velocity "∂x/∂t" from changing abruptly, while acceleration constraints will dictate that the incremental change in "∂x/∂t" from one time step to the next will not change very much. Similarly, each new solution for "x" will be predicted fairly accurately by extrapolation from the previous value of "x" and the previous value of "∂x/∂t" and by the expected change in "∂x/∂t". Thus, each new iterative solution will start from a very good initial estimate of the two unknowns, meaning that convergence can be obtained in very few iterations (perhaps as few as one iteration, depending on the quality of the algorithms.) Hence, one has an efficient method for determining updated values for position and velocity with each successive time step, based on measurements of voltage, current, and the time derivative of current.

The conclusion of this Specification describes steps for sensorless determination of position by a hybrid method, combining the flux integration method and the differential method. The concepts behind those steps are explained here.

In the present context, integration methods are inherently drift-sensitive and noise-insensitive. Differential methods are not subject to drift but may tend to be noise-sensitive. A hybrid of the integration and differential methods described above emphasizes the strengths of both and de-emphasizes the weaknesses. As illustrated in the Analog/Digital or A/D section of FIG. 6 and described below, specialized hardware may be provided to measure changes in current from one time step to the next, minimizing the noise problems inherent in the difference measurement. To the extent that noise creeps into the change-of-current data, however, the simultaneous solution method is noise-sensitive at high frequencies in both velocity error and position error. Step-to-step noise changes in position by this method do not imply much larger velocity errors, because velocity is not based on change in position from one time point to the next. Each (position, velocity) pair is computed independently of previous pairs. The differential method is weak near armature end positions and robust around middle positions. Why? Near end positions, the armature velocity is low, magnetic flux from the armature to the more distant yoke winding is at a low value, and current in that distant winding depends very weakly on the position and velocity of the distant armature. Thus, parts of the simultaneous equations are very weakly determined, leading to large errors in the overall outcome. Near middle armature positions, both solenoid windings have good couplings to the armature, and the armature velocity is high. Thus, all the terms in the simultaneous equations are well determined.

Errors in the integration method are quite different. When the armature is close to one yoke/winding, whether releasing or landing, then the determination of position from the near-side yoke/winding is robust. Determination error from the far-side yoke/winding is not important, since near-side data are sufficient. Position determination is particularly strong for the armature far off-center. For the armature closer to a middle position, velocity data suffer the most from the integral method.

Emphasizing the strengths of the two methods, velocities are determined from the integral method near take-off and landing and from the differential method for intermediate positions. Flux integrals are most uncertain for a releasing solenoid, since initialization of the flux integral is performed best for a pull-in yoke/winding when the armature is far away and flux is determined largely by current, with low sensitivity of position. Thus, position and velocity date from the differential method take over comparatively quickly following armature release and up to midway positions, at which point flux integration data from pull-in yoke/winding take precedence, first for position at middle positions, and later for velocity from changes in position as the magnetic gap closes.

DESCRIPTION OF A PREFERRED EMBODIMENT

Preferred Embodiment Part 1: Overview

For the purposes of this discussion, we arbitrarily define a "positive" current in either one of the solenoid windings as current flow from the end terminal toward the center terminal. We shall also consider that the driver circuitry for any one of the totem pole drivers functions to turn on either the pull-up or the grounding pull-down device at any given time, in response to a logic signal from the digital processor (CPU). The "off-off" or "tri-state" option for a totem pole driver output is not considered here, which is not to exclude this possibility as a configuration of the invention. Without limitation, we consider a configuration for the preferred embodiment in which the processor signals going to the two end power drivers are Pulse Width Modulation or PWM signals, while the processor signal to the center driver is a simple high/low logic signal. One may optionally run the center driver with a PWM signal as well, though the discussion to follow considers the simpler case where the center driver is held either high or low for time intervals in which the PWM drivers switch high and low several times.

Figure 2:
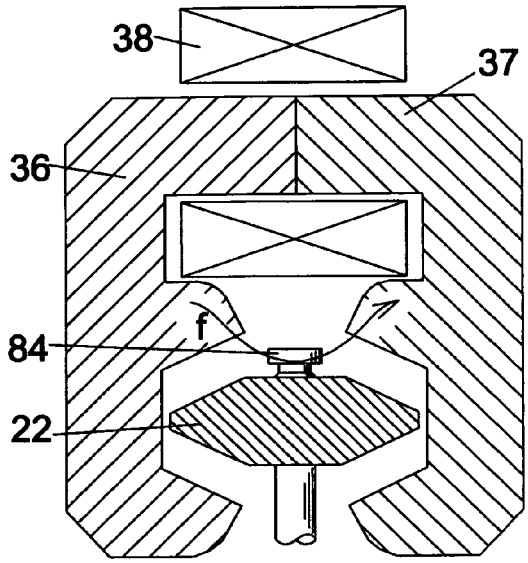
FIG. 2 (Prior Art)
FIG. 2 is an elevation section view of a single-armature dual-acting solenoid of the prior art, including just one winding driving a magnetic circuit capable of latching the armature in either of two positions.

Prior art FIGS. 1, 2, and 3 have already been discussed thoroughly. FIGS. 4, 5, and 6 collectively describe the hardware of a preferred embodiment of the invention. FIGS. 7, 8, and 9 show steps outlining the sensorless computation of armature position and velocity based on data obtained from the operating hardware plus empirical characterizations of the hardware (for example, the functions "L(x)" and "∂L/∂x".) The numbered items in FIGS. 4 through 9 are now described on the way to teaching how the invention works and how it can be built, in various configurations and variations consistent with the basic invention.

Preferred Embodiment Part 2: Hardware of the Three Wire Topology

FIG. 4 shows the basic layout of a dual-acting solenoid and specifically the wiring of two windings with four wire ends to three controller terminals. The solenoid consists of a shaft 430 (labeled at both ends) driven up and down by magnetic forces acting on an armature 420. Typically this shaft may be mechanically centered by springs, not shown, and the shaft motion may optionally be used to open and close a cylinder valve in an internal combustion engine, not shown. The armature 420 is pulled upward by attraction to a ferromagnetic yoke 400, which is energized by a winding 410. Similarly, armature 420 is pulled downward by attraction to a ferromagnetic yoke 405, which is energized by a winding 415. A first connecting wire from winding 410 goes to a first terminal 460 of controller 480, whose internal components are revealed in FIGS. 5 and 6. A second connecting wire from 410 is electrically joined to a first connecting wire from 415, giving rise to a common wire that joins to 480 at a second terminal 465. These latest connecting wires from 410 and 415 may optionally be brought separately into controller 480, and even and sensed driven separately, but for the purposes of this preferred embodiment, it is assumed that at some point the circuits from the two wires join at some shared effective terminal voltage, either inside or outside or at the surface of controller 480. Finally a second connecting wire from 415 goes to a third terminal 470 of controller 480. The following discussion now describes the control and measurement of current and voltage in terminals 460, 465, and 470, so as to drive armature 420 with economic electronic hardware and, optionally, to determine the position and possibly the velocity of 420 without sensors in the dual-acting solenoid, but rather by inference from sequences of electric currents and voltages through time.

FIG. 5 shows the important components of three-terminal PWM and on-off switching drive circuitry. Terminals 460, 465, and 470 and controller 480 are labeled as in FIG. 4, but the schematic inside box 480 now describes the important internal electronic components of a preferred embodiment. There is a power supply 535, indicated (optionally) as a source of positive potential "+V" along with wiring of that potential to internal components. There is a common ground 540 for the drive circuitry, including a nominal termination locus (symbolically a triangle) and wiring to drive components. There is a computation means 545, "CPU", whose supply and grounding means are not shown. This CPU 545 provides three control outputs, 555, 565, and 575, connecting respectively to right, center, and left driver circuits 525, 515, and 505. These three driver circuits are all connected to supply 535 and to ground 540. The output devices for the three driver circuits are indicated separately. For driver 525 there is pull-down device 530 (for example, a Field Effect Transistor of FET) with a ground connection to 540 and a control connection to 525 (for example, a FET gate connection); and there is pull-up device 531 with a positive supply connection to 535 and a control connection to 525. Devices 530 and 531 further share a common connection which joins to right-hand terminal 460. In similar fashion, left-hand driver 505 connects to pull-down device 510 and pull-up device 511, with connections to ground and the positive supply and with a common connection to left-hand terminal 470. The output circuitry of driver 515 is slightly different, using a pull-down device 520 similar to devices 510 and 530 but having the pull-up device replaced by a clamp diode 521. The anode of 521 shares the common connection with a terminal of 520 and with center terminal 465, while the cathode of 521 connects to positive power supply 535. There is no control connection between 521 and 515. It is seen that the driver circuitry of 515 may be simpler than in 505 and 525, since there is no pull-up device to be driven and consequently no need for level translation to drive a pull-up device. While enhancement mode FETS are known that allow a totem pole to be driven by a single gate voltage, potentially reducing drive circuits 525 and 505 to simple gate connections, most solenoid systems will require higher voltage operation and high current operation, calling for non-trivial circuitry in 525 and 505, with potentially simpler circuitry or just a connection in center driver 515.

Though various functional descriptions are possible, the description for this preferred embodiment is that control outputs 555 and 575 to the right and left driver circuits of 480 are Pulse Width Modulation or PWM outputs, while the control output 565 to the center driver circuit of 480 is a logic level output. Operation of 480 is described in a manner consistent with this description of PWM drives for the end drivers only in a preferred embodiment, with no intention that this description be limiting.

FIG. 6 shows the sensor components optionally added to complete an economic three-terminal sensorless servo controller. Right, center, and left terminals 660, 665, and 670 of device 680 correspond to terminals 460, 465, and 470 of device 480, but device 680 may differ from 480 in having internal components for sensorless determination of position, or position and velocity, including for servo control of the motion of armature 425. CPU 645 of FIG. 6 corresponds to CPU 545 of FIG. 5, except that 645 interfaces to an analog/digital or A/D interface 647 via bus 646. This bus is bidirectional, carrying timing information to the A/D for determining when voltage sampling takes place and carrying converted analog data back to the CPU. Though they are diagrammed separately, the CPU and much or all of the A/D interface may reside on a single semiconductor chip. The CPU in FIG. 6 has three outputs controlling right, center, and left drivers, as in 480. The labeled driver output components 610, 611, 620, 630, and 631 of 680 correspond respectively to components 510, 511, 520, 530, and 531 of 480. Component 621 is changed from corresponding component 521: the passive pull-up diode 521 becomes an active totem pole pull-up device 621, with connection to the positive power supply and to device 620, but also with a control connection (for example, a FET gate drive connection) to driver module 515.

The pull-down device 630 of the right-hand driver in FIG. 6 is connected not directly to ground 650, but to ground via series sense resistor 675. The voltage developed across 675 to ground is sensed at 677, an input to A/D converter 647. Note that to obtain a current reading, 647 must be timed to sample input 677 during the time interval that pull-down device 630 is switched on, so that the winding current from 660 is going through the sense resistor rather than along a path via device 631 to or from the power supply. It follows that current readings cannot be taken when the totem pole output is continuously high, meaning that the duty cycle must never exceed some maximum below 100%, allowing sufficient time for current sensing. Similar constraints apply where pull-down device 610 of the left-hand driver is connected to ground via series sense resistor 676, with the sensed voltage connecting via 678 to an input to A/D converter 647. More complicated circuitry could be used to overcome these constraints, but the simpler circuitry shown in FIG. 6 is assumed for the discussions to follow.

Within Analog/Digital or A/D conversion module 647 there is a schematic of analog buffer circuitry, both for the sense voltage from resistor 675 via connection 677 and similarly for the left-hand current sense resistor 676 via connection 678. The details of these simplified schematics on the right and left are not critical. The functionality, however, is important: to provide indications of current and rate-of-change of current in the right and left channels.

Examining the particulars of a simplified analog circuit schematic for buffering current and rate-of-change of current into A/D conversion circuitry, scaled analog signals representing sensed and amplified current are provided for A/D conversion at 685 and 686, respectively for the currents flowing through sense resistors 675 and 676 on the left and right. Deriving from signals 685 and 686 are signals representing rate-of-change of current at 690 and 691. The particulars of the schematics associated with these signals are not discussed.

In each circuit, normally-positive currents from an end totem pole to the center terminal result in negative voltages connecting from the current sense resistors into A/D module 647. On either side of 647, an inverting amplifier produces a positive current signal of greater magnitude than the negative voltage from the current-sense resistor. This amplified positive current signal, designated 685 on the right and 686 on the left, provides input to a sample/hold circuit, shown here as a switching FET, a band-limiting resistor in series with the FET, a capacitor to ground for retaining the sensed voltage when the FET is switched off, and a non-inverting amplifier serving as a high-impedance buffer for the stored capacitor voltage, thus providing the sample/hold output. A differencing amp outputs an amplified difference between the continuous amplified current signal and the sample/hold version of the same current signal. With appropriate DC biasing, this differencing amp can provide positive-only outputs for both positive and negative changes in current from one sampling interval to the next. Similarly the other amps can be biased for positive-only operation and may optionally operate from a single positive power supply. At appropriate times in the drive cycle, the output from the differencing amp will represent the change in current from one time step to the next, and this output is sampled for CPU input at amplifier output terminals 690 and 691, respectively on the right and left sides of the circuit. Immediately after sampling, the FET on either side is switched on, putting the sample/hold circuit in sample mode long enough to sample the present value of current and then hold that value until it is used for a current difference in the subsequent cycle. Other topologies are possible, as well as alternative approaches. For example, with sufficient A/D resolution and possibly high-frequency oversampling for digital signal filtering, analog filtering and amplification of difference signals is not needed and digital differences can be used. What is important is that the A/D module 647 provide current data and current-change or current-derivative data with sufficient resolution for the computations to follow.

The center driver output, with pull-down device 620 and pull-up device 621, has no current sensing. The current in the center leg is computed as sum of the currents sensed in the end legs, except with a sign reversal: positive-down in the center, positive-up on the sides.

Before current corrections, the starting voltages on controller output terminals 660, 665, and 670 are computed as the power supply voltage multiplied by the high-state PWM duty cycle fraction.

Now that the electronic hardware has been described, its operation will be discussed. With the center terminal (665) switched "low" so that the pull-down transistor pulls the terminal voltage down to or close to ground potential, either end driver can pull "high" to energize the magnetic field on the corresponding side of the dual solenoid. Proportional control in energizing a magnetic field is achieved by pulling an end driver "partially high" with a PWM duty cycle intermediate between 0% and an upper limit below 100%, this limit being set to assure a minimum time interval for current sensing in each operation cycle. It is seen that either end driver can maintain a current in the winding on that side while little or no current flows on the opposite side. This ability contrasts with a two-wire system, where there is current flow and unwanted energy dissipation in the "unused" side of the solenoid.

In an example of reducing a positive current and thus de-energizing the magnetic field in the right-hand yoke using the right-hand driver of FIG. 6, the left-hand and center drivers both pull fully "high" with 100% duty cycle while the right-hand driver pulls "partially low" with a duty cycle less than 100%. When the right side is being de-energized rapidly, current in the left side is normally at or near zero, and a temporary cessation of current readings on the left may be tolerable while 100% duty cycle is employed. Other control and/or hardware options are possible for uninterrupted current sensing on both sides. Short of using circuitry that senses current during both high and low driver states, one can provide an independent PWM signal to the center driver, or one can switch the center driver to match the PWM of a selected one of the right and left end drivers. With the center and one side matched in PWM, that duty cycle can be set at a high value below 100%, permitting current sensing while applying zero voltage differential across the "unused" solenoid winding. With the left and center drivers maintained high, at 100% duty cycle or at a high value below 100%, then a "fully low" output on the right, at 0% duty cycle, gives the maximum rate of field reduction, while higher duty cycles on the right give lesser controlled rates of field reduction. The matching high voltages from the left-hand and center drivers result in a zero or near-zero potential difference across the left-hand winding, thus providing no voltage to sustain a magnetic field on the left.

Operation of the simpler drive circuitry of FIG. 5, with diode clamping rather than active pull-up for the center driver, is analyzed differently. When the center driver output 465 is pulled down, there is no change from the situation where 665 is pulled down by device 620 of FIG. 6. Recall that in a preferred approach to control, currents from both end drivers are maintained positive or near-zero, with current flowing toward the center leg. Thus, when pull-down device 520 is switched off, there will always be a forward current through clamp diode 521 into the positive power supply. The current through that diode will then be the sum of the current readings in the right and left drivers, and a nonlinear model of the diode's forward voltage-versus-current characteristic can be employed to compute the terminal voltage rise above the measured power supply voltage. Hence, the voltage at 465 can be determined at all times, though perhaps with less accuracy than the voltage at 665, since temperature dependence of the diode model and other factors may compromise accuracy to some degree.

It may be desired to de-energize one side of the solenoid while simultaneously energizing the opposite side. It is readily seen that such an operation calls for setting the center terminal at a voltage intermediate between the two end voltages, so that one end driver potential (of short-term-average potential over a PWM duty cycle) is below the center potential while the opposite end driver potential is above the center potential. To accomplish this in a "continuous" fashion (for time scales exceeding the PWM pulse period) one would need to provide an independent PWM signal to the center driver. Alternatively, the center driver can be switched high and low on the longer alternating cycles of sampling and PWM-setting, which of course introduces a lower frequency of switching noise and excitation into the solenoid, potentially complicating the process of sensorless determination of armature position. Observe also that the sum of the down-slew rate of current on one side and the up-slew rate on the opposite side is constrained by the supply voltage. Here is the one situation where the three-wire system cannot perform like a four-wire system with two independent full-wave bridge circuits driving the two independent windings. With a four-wire system, one winding current can slew upward while the other winding can slew downward, both of them at slew rates determined by the full power supply voltage.

In the discussion to follow, it will be assumed that a releasing-side winding can have its flux linkage reduced quickly before it is necessary to begin a rapid increase in flux linkage in the winding on the pull-in side. The releasing flux level may typically be left at a small positive value and left to decay gradually as the potential difference is removed from that side. This "coasting" mode dissipates little energy and provides more information for sensorless position determination than a zero-current situation.

In normal operation of a dual-acting solenoid, it is not necessary or desirable to have both yokes strongly energized at the same time—that would waste energy. Such operation is possible, however, if the center terminal switches "on" (pulling "down") while the two end terminals simultaneously pull "up" at controlled duty cycles.

The three-terminal circuitry described here is intermediate in cost between the two-terminal circuitry described in U.S. Pat. No. 6,724,606 and conventional four-terminal circuitry. While a "conventional" topology using two full-wave bridges requires eight high-current devices, four in pull-down positions and four more in more expensive pull-up positions (requiring more drive circuitry), the three-terminal topology of FIG. 5 uses just five high-current devices, three of which are in pull-down positions with just two in the more expensive pull-up positions. The variant in driver topology of FIG. 6 uses six high-current devices, three for pull-down and three for pull-up. Compared to the topology of FIG. 5, the minimalist two-terminal topology of U.S. Pat. No. 6,724,606 further eliminates only one pull-down device, leaving four high-current devices, two for pull-down and two for pull-up. This small cost saving sacrifices efficiency due to resistive power loss in an unused winding and due to partial magnetic force cancellation from the unused yoke, and it also sacrifices an ability for robust starting.

Observe that there are many other options for the hardware. For example, instead of measuring current in the ground leg of the pull-down device of totem pole, one can use an optically isolated device that rides up and down on the switching potential in an output wire between terminal 660 or 670 and the corresponding totem pole, measuring that current at all times. PWM signals from a microprocessor or DSP chip are not the only way to control a switching output. The micro or DSP can output an analog or digital signal to a separate PWM chip or to a Class-D amplifier. Determination of output voltage can be "indirect" as shown above, involving the product of one or more measured power supply voltages with a PWM duty cycle, or it can be a more "direct" measurement, involving direct measurement of output voltages in conjunction with a linear or nonlinear or gated or modulated filtering process to reject the switching frequency and its harmonics and yield short-term-averages of output voltage. The important elements of the present invention concern interconnecting two solenoid windings to three terminals and the hardware simplifications and cost savings that follow from driving three outputs instead of four.

Preferred Embodiment Part 3: Sensorless Position and Velocity Determinations

The three-terminal approach permits better sensorless determination of armature position and velocity than is possible with two terminals. Sensorless determination of position can be accomplished in both two-terminal and three-terminal dual solenoids by extensions of the flux integration methods taught by Bergstrom in U.S. Pat. No. 6,249,418. In the two-terminal case, however, the older methodology gives poor determination of position near center-position. The present three-terminal approach overcomes this limitation, giving robust position information at all positions.

The following discussion will present two independent methods for sensorless determination of position and velocity and for a hybrid of the two methods. As was described in Part 3 of the Summary of the Invention section, the two methods have complementary strengths and weaknesses. The hybrid method incorporates the best aspects of both.

To put sensorless determination of position in context, the steps of FIG. 7 walk through a typical servo-controlled armature trajectory from latched against a left-side winding/yoke through release and capture on the opposite winding/yoke, and back again in a cycle. The abbreviated step descriptions are each repeated and then elaborated.

FIG. 7 Description

1 Start Left:

solenoid latched on left flux known right "eyes on" current

The cycle of latching on one side, releasing, and latching on the opposite side is started arbitrarily on the left side, with the solenoid latched. The flux is presumed to be known at this point. A comparatively small "eyes on" current is maintained in the opposite winding, on the right, as this current will be needed soon for sensorless detection of position.

2 Negative left voltage

A negative applied winding voltage is defined as the polarity that reduces the flux linkage, or simply flux. This negative voltage is applied slightly before valve release is desired.

3 Track falling left flux

The flux linking the left-hand winding begins to fall, due to the negative applied voltage. This changing flux level is tracked using steps that will be described separately with reference to FIG. 7*a*.

4 Detect release current decrease slows

As the left winding flux falls, the winding current initially falls in proportion to the flux, indicating an unchanging position. When the current begins to decline more slowly than in the earlier constant proportion to flux, this indicates that release has begun.

5 Track left gap

Sensorless position determination initially relies on magnetic interactions between the armature and the left-side winding/yoke. The particulars of this position determination are described with reference to FIG. 7*a*.

6 Track left velocity

Differences in position, computed from the left winding/yoke, indicate armature velocity.

7 Optional: positive left voltage correct release energy

Following an initial negative applied voltage to reduce flux and cause release, a positive voltage pulse may be applied to bring the flux level back up briefly. The effect will be to pull back on the receding armature, slowing its travel and reducing its kinetic energy, which reduces the total mechanical of the armature (summing kinetic plus potential energies.) An energy reduction may be needed if the armature is expected to approach the right hand side with excess energy. To latch a solenoid, the flux level must begin to rise in advance of landing so that the level is sufficient to hold the armature immediately after landing. Given practical slew rate limits on flux change, landing with latching can occur only if a significant attraction force operates on the armature as it approaches landing. Thus, inevitably the armature will gain some mechanical energy on its landing approach. Pull-in magnetic control forces can only add mechanical energy—they cannot reduce energy. Excess energy in the incoming armature thus leads inevitably to hard landing and, in a bad scenario, to bounce and failure to latch. Gas pressures acting across an opening valve can add energy to the valve motion, for example when an intake valve opens toward a partial vacuum in the cylinder. The solenoid spring might also be biased intentionally off-center, for example to favor opening of an exhaust valve against a high cylinder pressure. With such a bias, the valve will have excess landing energy whenever a relatively high cylinder pressure is absent. Step 7 represents an intentional drain of mechanical energy by the releasing side, as needed to correct the release energy and satisfy the preconditions for soft landing with latching.

8 Initialize right flux from left gap right gap known from left gap right current known therefore right flux determined The positioning of Step 8 in the sequence of steps is variable. It is possible to move this step prior to Step 2, while the armature remains latched on the right and the left-hand gap is in a known state, maximally open. In that case the right gap is known from the closed left gap. At a measured current in the right-hand winding, the initialization flux linkage is then a known multiple of the current—or conveniently zero (give or take a hysteresis correction) if the right winding current is zero. Alternatively, the right-side flux can be initialized later, with the armature in motion and ideally while the armature is still relatively close to the left yoke, where its position is well-defined by the magnetic relationships (current/flux) of the left winding/yoke. As indicated in the description of Step 8, the left solenoid gap is a calibrated function of the measured ratio of current/flux in the left winding, so the left gap is known. Since the sum of the two gaps is constant (for the armature moving between two yokes whose spacing is constant), the right gap is known from the value of the left gap. The right-hand current/flux ratio is a known function of the right gap. The current in the right winding is known by measurement. Thus, the absolute flux can be computed and used to initialize the right flux integration. The flux integral will continue, accumulating small drift errors, until it is reinitialized at the next repetition of Step 8 in the operation cycle of the solenoid.

9 Reduce left current to "eyes on"

Current in the left winding is reduced to an "eyes on" value, not great enough to cause a large force or to cause a high energy dissipation, but a sufficient current for position determinations via ratios of current/flux.

10 Track right flux, position, velocity

The tracking steps for flux (or flux linkage), position, and velocity are delineated in FIG. 7*a*.

11 Servo right flux vs position, velocity

This is the basic servo control operation. Magnetic flux is servo-controlled to track a target flux that is expressed as a function of two variables, position "X" and velocity "V": target flux=F(X,V). Velocity "V" however is actually a difference of previously computed values for position "X." In U.S. Pat. No. 7,099,136 B2, "State space control of solenoids", one of the authors of this patent (Seale) describes how to define a target flux function F(X,V) making sophisticated use of past information and a dynamic description of the controlled solenoid to attain control with feed-forward information and good noise immunity.

12 Detect right landing

The current/flux ratio in the right-hand winding will reach a minimum value indicating that the distance to landing is either zero or too small to resolve. If the current/flux ratio, or the position computed from that ratio, falls to a low value and exhibits a bounce of magnitude exceeding the noise level in the position determination, that indicates a right landing with a bounce.

13 Latch right flux up, down current held fixed hysteresis aids hold

When landing or near-landing (within noise uncertainty) is detected, the flux linkage in the right winding is driven upward to a level that assures latching and that also induces some hysteresis in the right yoke. The flux is then brought down to a lower holding value with a more-than-proportionate reduction in current. This extra reduction in current is a result of hysteresis. If the flux were simply brought up to the holding value and then maintained steady, more current is required at that holding flux than is required when the flux is raised higher and then brought back down to the same holding flux. Thus, hysteresis aids in holding a latched state by reducing the power requirement. Following the hysteresis maneuver, flux integration and servo control of flux are suspended, with current being servo-controlled to a constant value.

14 Correct right position for hysteresis

Hysteresis introduces an offset into the value of current used in computing position from the ratio current/flux. This offset changes direction when the direction of flux change is reversed. Thus, following the "flux up, down" maneuver of the previous step, and with subsequent further reductions in flux to release the armature, a new offset should be summed with current before computing position from current/flux, thus correcting the right-yoke computation of position for the effect of hysteresis.

15 Hold right until release signal

Latching is maintained at a fixed holding current until a signal arrives calling for armature release.

16 Start Right

This is the right-side counterpart of Step 1.

17 (steps mirror the Start Left steps)

Steps 1 through 15 are repeated, except in "mirror image" with left and right reversed.

18 Hold left until release signal

This is the "mirror equivalent" of Step 15, with sides reversed, concluding the mirror sequence.

19 Return to Start Left

The flow chart arrow returns to Step 1.

Within the steps of FIG. 7 are repetitions of a more basic flux-tracking and position-computing process described more thoroughly in FIG. 7*a*. These steps are now discussed.

FIG. 7*a* Description

1 Start Track:

PWM known

Flux known

At the start of a tracking cycle for flux, position, and velocity, the most recent setting for the PWM duty cycle is known, as is the latest running total of the flux integral.

2 Read supply volts

3 Update filtered supply volts

The power supply output includes large filter capacitors, which prevent the supply voltage from changing quickly. Thus, a digitally lowpass-filtered version of the supply voltage can be used in calculations and has the advantage of a better signal/noise ratio.

4 Multiply filtered supply volts by PWM

This product, called "volts" below, is the average applied voltage over one or more PWM duty cycles at a constant duty cycle setting. This product does not account for resistive voltage losses.

5 Read current

This is an A/D conversion of an amplified signal from a current sense resistor. For the hardware topology illustrated in FIG. 6, it is necessary to take the current reading during the low-output portion of the PWM duty cycle. Furthermore, given the cyclic ripple in the current waveform at the PWM frequency, an approximation of the average current over a PWM cycle may be obtained by sampling at a time that effectively samples the middle of a sloping portion of the roughly triangle-wave-shaped current waveform.

6 Subtract I·R from (Volts)·(PWM)

Here "I" is the current that was read in step 5, and "R" is an estimate of the total circuit resistance, including resistance in switching devices, board traces, connectors, wiring, and the solenoid winding. The (volts)·(PWM) product uses the filtered supply voltage and the PWM duty cycle. Subtracting the "I·R" correction from the (volts)·(PWM) product yields the inductive voltage, which equals the time rate-of-change of "flux" or, more strictly, flux linkage.

7 Sum to flux integral

The inductive voltage obtained in Step 6 is scaled and summed to the flux integral. In actual physics units, the inductive voltage should be multiplied by the time step "Δt" before summation to the flux integral, but in practice some other convenient scaling may be chosen.

8 Compute current/flux

The ratio of winding current divided by the flux integral is a nonlinear measure of position. There may be corrections to this measure, compensating for hysteresis, expected eddy currents, etc.

9 Compute position

Position is expressed as an empirically calibrated function of the current/flux ratio.

10 Compute velocity

Commonly, velocity is computed as the difference between the most recent and next-most recent computed values of position, with a scale factor "1/Δt" taken into account somewhere.

11 Compute target flux (position, velocity)

The "target flux" is not the actual flux, but the computed value that flux should attain at some specified time in the very near future, on the order of one or two time steps "Δt" into the future. This target flux is computed as a function of two variables, position and velocity. A more sophisticated and more noise-immune computation might also take account of information projected from past data readings, for example the "path number" described in U.S. Pat. No. 7,099,136 B2, "State space control of solenoids", as mentioned in the commentary of Step 11 of FIG. 7. The objective is to take account of known dynamic characteristics of the controlled solenoid, and also account for delays in the sampled-data control process, thereby anticipating and compensating for predictable dynamic delays in the control process.

12 Reset PWM

The PWM is set so that the projected inductive voltage at the next repetition of Step 6 will cause flux to reach the target flux of Step 11 at the specified future time. Thus, the new PWM setting takes account of: the inductive voltage needed to obtain the needed change in the flux integral; the expected "I·R" correction to get from inductive volts to applied volts; and the supply voltage whose product with PWM will provide the specified applied volts.

Step 12 concludes one repetition of the tracking process, which resumes back at Step 1. This process of FIG. 7*a* is invoked many times, for both the left-hand and right-hand driver circuits of FIG. 6, during the course of a left-to-right or right-to-left armature transit process as described with reference to FIG. 7.

Derivative Method for Sensorless Position, Velocity

As with flux integration, determination of inductive voltage is central to the derivative method for determining sensorless position and velocity. Repeating concepts introduced above using more explicit mathematical notation, the inductive voltage $V_i$ is defined by the applied voltage, $V_{app}$, minus the product of current I with resistance R:

$$V_i = V_{app} - I \cdot R \qquad 1]$$

The applied voltage itself might be computed as the product of a supply voltage times a PWM duty cycle, or it might be measured directly by various means.

The inductive voltage determines the time derivative of the flux linkage, λ.

$$\partial\lambda/\partial t = V_i \qquad 2]$$

Flux linkage λ is the summation, over the turns of a winding, of the flux that links each turn. Flux linkage is related intimately to current I and inductance L:

$$\lambda = I \cdot L \qquad 3]$$

Thus:

$$\partial I \cdot L/\partial t = V_i \qquad 4]$$

The partial derivative of the current-times-inductance product on the left of Eq. 4 can be expanded using the chain rule of calculus:

$$L \cdot \partial I/\partial t + I \cdot \partial L/\partial t = V_i \qquad 5]$$

The context of this invention is a solenoid whose electromagnetic and mechanical characteristics are known in advance, with this knowledge being embodied in computer control codes and data. Specifically, the relationship between inductance L and armature position x is specified by an empirical function L(x), which can be represented as a polynomial fit to data, a lookup table, an interpolating lookup table, or any other empirical equation that is convenient and sufficiently accurate:

$$L = L(x) \ldots \text{an empirically derived functional relationship} \qquad 6]$$

Position x varies with time, so that the derivative ∂x/∂t expresses the armature velocity. The time derivative ∂L/∂t can thus be rewritten in as the product of ∂L/∂x and ∂x/∂t:

$$L(x) \cdot \partial I/\partial t + I \cdot \partial L(x)/\partial x \cdot \partial x/\partial t = V_i \qquad 7]$$

Just as L(x) is an empirical function of x, ∂L(x)/∂x is the derivative of L(x) evaluated at x. Eq. 7 is applied twice, to the left and right sides of the solenoid—call them side 1 and side 2 with associated armature-to-yoke gaps of $x_1$ and $x_2$. We will have currents $I_1$ and $I_2$ in the two yokes and inductive voltages $V_{i1}$ and $V_{i2}$, computed from the voltage differentials applied across the two windings and with corrections for the currents in the two windings as well as in the center and two end driver circuits. For simplicity we shall assume that the inductance function L(x) is the same function of gap x whether x happens to be $x_2$ or $x_2$. (If the inductance functions are not matched, the following equations are easily rewritten with different function names for the two sides.) Thus we can write subscripted versions of Eq. 7 for side 1 and side 2 of the solenoid:

$$L(x_1)\cdot\partial I_1/\partial t+I_1*\partial L(x_1)/\partial x\cdot\partial x_1/\partial t=V_{i1} \quad 8]$$

$$L(x_2)\cdot\partial I_2/\partial t+I_2*\partial L(x_2)/\partial x\cdot\partial x_2/\partial t=V_{i2} \quad 9]$$

Here the notations $\partial L(x_1)/\partial x$ and $\partial L(x_2)/\partial x$ refer to the partial derivative function $\partial L(x)/\partial x$ evaluated at $x=x_1$. Eqs. 8 and 9 do not describe separate solenoids, but a single two-sided solenoid with a rigidly fixed distance between the two yokes. This geometry leads to an equation of constraint linking the two gaps, $x_1$ and $x_2$. The sum of the two gaps is constrained to be a constant, C, which happens to be the maximum possible gap on either side of the solenoid when the opposite side is latched closed:

$$x_1+x_2=C \quad 10]$$

Differentiating Eq. 10 with respect to time yields another equation of constraint:

$$\partial x_1/\partial t+\partial x_2/\partial t=0 \quad 11]$$

Solving Eqs. 10 and 11 to express $x_2$ and $\partial x_2/\partial t$ in terms of $x_1$ and $\partial x_1/\partial t$ and then substituting into Eq. 9, yields:

$$L(C-x_1)\cdot\partial I_2/\partial t-I_2\cdot\partial L(C-x_1)/\partial x\cdot\partial x_1/\partial t=V_{i2} \quad 12]$$

As with previous notation, $\partial L(C-x_1)/\partial x$ means $\partial L(x)/\partial x$ evaluated at $x=C-x_1$. The negative sign before the second product (of three multiplied terms) on the left of the equation arises because Eq. 11 implies the substitution $\partial x_2/\partial t=-\partial x_1/\partial t$. Even though the expression $\partial x_1/\partial t$ looks like a time derivative, for the purposes of solving these equations it is treated like a simple unknown number, a velocity. To clarify this simplicity we rename $\partial x_1/\partial t$ as $V_1$:

$$\partial x_1/\partial t=V_1 \quad 13]$$

Now repeating Eqs. 8 and 12 with the substitution of Eq. 13, we arrive at a pair of simultaneous equations:

$$L(x_1)\cdot\partial I_1/\partial t+I_1\cdot\partial L(x_1)/\partial x*V_1=V_{i1} \quad 14]$$

$$L(C-x_1)\cdot\partial I_2/\partial t-I_2\cdot\partial L(C-x_1)/\partial x\cdot V_1=V_{i2} \quad 15]$$

In these two equations, the functions $L(x)$ and $\partial L(x)/\partial x$ are known empirical characteristics of the solenoid, while the voltages, currents, and current derivatives, $V_{i1}$, $I_1$, $\partial I_1/\partial t$, $V_{i2}$, $I_{12}$, and $\partial I_2/\partial t$ are determined from combinations of measurement and computation. That leaves only two unknowns: $x_1$ and $V_1$, the position and velocity of the armature. The two equations are linear in the unknown velocity $V_1$ but nonlinear in $x_1$. We can solve for $V_1$ in one of the equations, for example Eq. 14, and substitute into the other equation, eliminating the velocity unknown and leaving one nonlinear equation in one unknown, position $x_1$:

$$V_1=[V_{i1}-L(x_1)\cdot\partial I_1/\partial t]/[I_1\cdot\partial L(x_1)/\partial x] \quad 16]$$

Substituting the expression for $V_1$ from Eq. 16 into Eq. 15 yields:

$$L(C-x_1)\cdot\partial I_2/\partial t-I_2\cdot\partial L(C-x_1)/\partial x\cdot[V_{i1}-L(x_1)\cdot\partial I_1/\partial t]/[I_1]*\partial L(x_1)/\partial x\cdot=V_{i2} \quad 17]$$

Rewriting with similar terms grouped together:

$$L(C-x_1)\cdot\partial I_2/\partial t-V_{i2}\cdot+[L(x_1)\cdot\partial I_1/\partial t-V_{i1}]\cdot[I_2/I_1]\cdot[\partial L(C-x_1)/\partial x/\partial L(x_1)/\partial x]=0 \quad 18]$$

For clarity, parentheses "(" and ")" are used to enclose function arguments, while square brackets "[" and "]" are used to group terms. For purposes of iterative solution, we can write:

$$F(x)=[L(C-x)\cdot\partial I_2/\partial t-V_{i2}]+[L(x)\cdot\partial I_1/\partial t-V_{i1}]\cdot[I_2/I_1]\cdot[\partial L(C-x)/\partial x/\partial L(x)/\partial x] \quad 19]$$

Solve for $x$: $F(x)=0$; the solution gives $x_1=x$. 20]

Substitute the $x_1$ solution: $V_1=[V_{i1}-L(x_1)\cdot\partial I_1/\partial t]/[I_1\cdot\partial L(x_1)/\partial x]$ 21]

In solving these equations, note that the measured time derivatives of current, $\partial I_1/\partial t$ and $\partial I_2/\partial t$, inevitably involve some delay, be it the group delay of a band-limiting filter or the delay of computing $\Delta I_1/\Delta t$ and $\Delta I_2/\Delta t$, finite changes in current measured over finite time intervals. For consistency of the computation, the measured currents and inductive voltages should be time-corrected to delays matching the current derivative delay. Then the solutions for position and velocity will be delayed. The state space methodology taught in U.S. Pat. No. 7,099,136 B2 is then applicable, using a system model to provide feed-forward information for projecting target flux linkage values from recent past data into the near future. Finally, note that this feed-forward control method provides fairly accurate predictions of position in vicinity of the present time, given a previously-determined position and velocity, plus an acceleration that is being controlled to maintain a predictable, desired trajectory. Thus, the iterative solution for $F(x)=0$ can be started with an initial x that is very close to the solution. It is likely that a single iteration of a good algorithm will give adequate convergence on each time step.

The outcome of the derivations given above is summarized in the steps of FIG. 8. These steps are repeated below with brief commentary.

FIG. 8 Description

1 Define inductance function $L(x)$.

This is an empirical function fit to low frequency inductance of the solenoid, as a function of the geometric gap x between the yoke on one side and the armature. These steps define the case where the inductance function is symmetric for the yokes on either side of the armature.

2 Define inductance derivative function $\partial L(x)/\partial x$.

This is related to the function fit for $L(x)$, providing a readily computed derivative function.

3 Define function $F(x)$:

$$F(x)=[L(C-x)\cdot\partial I_2/\partial t-V_{i2}]+[L(x)\cdot\partial I_1/\partial t-V_{i1}]\cdot[I_2/I_1]\cdot[\partial L(C-x)/\partial x/\partial L(x)/\partial x]$$

This more complicated function $F(x)$ incorporates the $L(x)$ and $\partial L(x)/\partial x$ functions, along with terms derived from current, current-derivative, and inductive voltage measurements and computations. "C" is the constant sum of the two yoke-armature gaps of the dual solenoid.

4 Code iterative solution for $F(x)=0$ giving solution $x_1=x$.

Efficient computer code will be needed for a quick determination of $x_1$ such that $F(x_1)=0$. Note that the code can take advantage of the relative predictability of the change in x for the previously determined value.

5 Code solution $V_1=[V_{i1}-L(x_1)\cdot\partial I_1/\partial t]/[I_1\cdot\partial L(x_1)/\partial x]$ Given a computed position and the data needed to compute that position, the computation of velocity is straightforward.

6 Coordinate data acquisition for delay-matched $\partial I_1/\partial t$, $\partial I_2/\partial t$, $I_1$, $I_2$, $V_{i1}$, $V_{i2}$.

This step reminds us that the sampling and group delays for the measured/computed variables should be matched for consistent computations of position and velocity. This step concludes the preparations for the real-time loop of the following steps.

7 Acquire real-time data.

This step is repeated throughout the servo control process.

8 Solve for armature position $x_1$ and velocity $V_1$.

This step is repeated throughout the servo control process. The process loops repeatedly back from this solution Step 8 to the data acquisition Step 7.

Hybrid Method for Sensorless Position, Velocity

Separate methods have been described for computing position and velocity.

The integral method is based on a running determination of magnetic flux linkage and leads to a computation of position. Velocity is computed from changes in position. This method requires re-initialization of the flux integral at regular intervals, to avoid drift problems. The method is most robust for the armature near one or the other of the two yokes and is weaker for midway positions.

The derivative method is based on the same inductive voltage that was integrated to track flux in the integral method, as well as on the same measured currents in the two yokes. The method also uses changes in current or measures of the time derivative of current, giving rise to measures of position and velocity. The method is robust for midway positions where there are strong electromagnetic interactions between both yokes and the armature, while the computation becomes less accurate for the armature near either end position.

FIG. 9 Description

The hybrid method uses the best information from the integral and derivative methods.

In a preferred embodiment, the choice of method for position and velocity inference is based on position and direction, as described by the following steps, as shown in FIG. 9:

1 Going from yoke 1 to yoke 2, the integral method is used from release up to a first armature position X1, at which point the derivative method takes over. The flux integral is for the releasing yoke 1.

2 Use of the derivative method is continued up to a second armature position X2, at which point the integral method takes over.

3 The yoke-2 flux integral is initialized based on the last position computed by the derivative method and by the yoke 2 winding current associated with that position.

4 Flux integration is terminated after latching is achieved and flux is brought to a final holding flux. At that point, current is held constant.

5 Flux integration resumes when release is called for. The initial value of the flux integral is the value last computed when current was held constant.

6 Going from yoke 2 to yoke 1, perform the mirror image of Step 1, with a method transition at X3. This position does not necessarily represent the same gap from yoke 2 that X1 represented from yoke 1, since conditions moving in the two directions may differ systematically, for example, because of differences between opening and closing a valve, asymmetry in the armature spring bias, etc.

7 The mirror of Step 2, but using X4 rather than X2 as the threshold for method transition.

8 The mirror of Step 3.

9 The mirror of Step 4.

10 The mirror of Step 5. From here, control loops back to Step 1.

While the above descriptions and examples define various particular configurations of the current invention, the scope of the invention will be better understood from the following claims.

What is claimed is:

1. A dual-latching solenoid system, comprising:

a) a first electromagnetic yoke;

b) a second electromagnetic yoke, magnetically separate from said first yoke;

c) an armature, movable bidirectionally between a first latching position adjacent said first yoke and a second latching position adjacent said second yoke;

d) first and second drive windings, generating flux respectively in said first yoke and said second yoke;

e) interconnection between said drive windings providing three connections for coupling said drive windings to drive circuitry, said three connections including two end connections, one from said first drive winding and a second from said second drive winding, and the third connection being a center connection electrically common to the separate drive windings; and f) electronic driver apparatus including three power output terminals driving said first and second yokes via said three connections.

2. The system of claim 1, wherein said driver apparatus provides switching regulation of the voltages applied to said three power output terminals.

3. The system of claim 2, wherein two of said three power output terminals are driven by bridge drivers in said driver apparatus, said bridge drivers including both pull-up and pull-down devices, while the third of said three power output terminals is driven by an output stage consisting of a transistor and a diode.

4. The system of claim 1, wherein all three of said power output terminals are driven by bridge drivers in said driver apparatus, said bridge drivers including both pull-up and pull-down devices.

5. The system of claim 1, said electronic driver apparatus further comprising controller apparatus for sensorless position measurement by measuring a current at one of said solenoid end connections and by determining a voltage at one of said solenoid end connections, and then inferring a position of said armature from said measuring a current and said determining a voltage.

6. The system of claim 5, said controller apparatus further measuring voltage differentials across both said first and second windings, measuring currents flowing in both said first and second windings, measuring rates-of-change of said currents flowing in both said first and second windings, and further utilizing prior knowledge of electromagnetic characteristics of said solenoid system to determine the position and velocity of said armature.

7. The system of claim 6, wherein said prior knowledge includes knowledge that the sum of the two gap widths between said armature and said first and second electromagnetic yokes is constrained by the geometry of said solenoid system.

8. An electrical driver and controller for a dual-latching solenoid system, comprising:

a) switching regulation means;

b) output voltage determination means;

c) output current sense means; and d) one or more sets of three output terminals, each said set being designed to drive a pair of windings in a dual latching solenoid, said pair of windings being wired with two separate wire end connections and one connection common to wire ends from each member of said pair of windings, wherein said output voltage determination means controls an output voltage to achieve predetermined average voltage values, as averaged over entire cycles of a pulse width modulated output.

9. An electrical driver and controller for a dual-latching solenoid system, comprising:

a) switching regulation means;

b) output voltage determination means;

c) output current sense means; and d) one or more sets of three output terminals, each said set being designed to drive a pair of windings in a dual latching solenoid, said pair of windings being wired with two separate wire end connections and one connection common to wire ends from each member of said pair of windings, wherein said output voltage determination means controls an output voltage to achieve predetermined average voltage values, as averaged over entire cycles of a pulse width modulated output, and wherein said output voltage determination means and said output current sense means are used, in combination with prior knowledge of characteristics of a dual-latching solenoid to be driven, to measure the position of the armature of said solenoid without the use of sensors in said solenoid to be driven, excepting as drive windings in said solenoid to be driven serve indirectly as position sensors through interpretation of electrical characteristics of said drive windings.

* * * * *